US008984754B1

(12) United States Patent
Kaidi et al.

(10) Patent No.: US 8,984,754 B1
(45) Date of Patent: Mar. 24, 2015

(54) NAIL CLIPPER WITH BLADE-INSERT

(76) Inventors: Alexandre Rachid Kaidi, Napa, CA (US); Hamid Reza Shamsapour, San Rafael, CA (US)

( * ) Notice: Subject to any disclaimer, the term of this patent is extended or adjusted under 35 U.S.C. 154(b) by 700 days.

(21) Appl. No.: 11/305,561

(22) Filed: Dec. 15, 2005

(51) Int. Cl.
*A45D 29/02* (2006.01)

(52) U.S. Cl.
CPC ..... *A45D 29/02* (2013.01)
USPC ..... 30/28

(58) Field of Classification Search
USPC ..... 30/26, 27, 28, 29, 175, 179, 253, 260; 132/75.5; D28/60; 606/211
See application file for complete search history.

(56) References Cited

U.S. PATENT DOCUMENTS

| | | | | | |
|---|---|---|---|---|---|
| 327,065 | A * | 9/1885 | Burton | 132/75.5 |
| 796,389 | A * | 8/1905 | Wright | 132/75.5 |
| 3,914,866 | A * | 10/1975 | Applegate | 30/233.5 |
| 3,997,966 | A * | 12/1976 | Sartore | 30/28 |
| 4,130,937 | A * | 12/1978 | Kim | 30/28 |
| 4,731,927 | A * | 3/1988 | Wilson | 30/28 |
| 4,776,090 | A * | 10/1988 | Grassi | 30/28 |
| 4,819,673 | A * | 4/1989 | McMullen, Jr. | 132/75.5 |
| 5,074,041 | A * | 12/1991 | Wagner | 30/28 |
| 5,331,739 | A * | 7/1994 | Basangy | 30/28 |
| 5,353,505 | A * | 10/1994 | Okada | 30/253 |
| 5,488,772 | A * | 2/1996 | Dababneh et al. | 30/28 |
| 5,621,974 | A * | 4/1997 | Rose et al. | 30/260 |
| 5,964,033 | A * | 10/1999 | Wolf | 30/28 |
| 5,983,498 | A * | 11/1999 | Lieberman et al. | 30/28 |
| 6,606,794 | B2 * | 8/2003 | Rieser | 30/28 |
| 6,941,657 | B2 * | 9/2005 | Choi et al. | 30/28 |
| 7,020,964 | B2 * | 4/2006 | Han et al. | 30/28 |
| 7,024,774 | B2 * | 4/2006 | Novellie et al. | 30/28 |
| 7,210,230 | B2 * | 5/2007 | Wurzel | 30/260 |
| 8,683,700 | B1 * | 4/2014 | Kaidi et al. | 30/28 |
| 2009/0211098 | A1 * | 8/2009 | Childs, II | 30/28 |

* cited by examiner

*Primary Examiner* — Hwei C Payer
(74) *Attorney, Agent, or Firm* — Risto A. Rinne, Jr.

(57) ABSTRACT

An apparatus for cutting toenails and fingernails includes a frame member that includes an upper frame member and a lower frame member. One of a pair of cutting blades is attached to a front of the upper frame member and a remainder of the pair of cutting blades is attached to a front of the lower frame member so that a cutting edge of each of the pair of cutting blades are in alignment and face each other. According to certain preferred embodiments, the device is disposable. According to certain other preferred embodiments each of the pair of cutting blades can be replaced with a new replacement blade assembly. Various embodiments are shown sufficient to illustrate a portion of the versatility and benefits that are possible including the use of plastic to form the frame member, steel or other suitable material to form the pair of cutting blades, low manufacturing cost, lightweight, offering of the apparatus in different styles and colors, it use for advertising, and less likely to be detected by airport security personnel.

13 Claims, 3 Drawing Sheets

NAIL CLIPPER WITH BLADE-INSERT

This application is related to patent application Ser. No. 11/226,811, entitled Nail Clipper, that was filed on Sep. 13, 2005, now U.S. Pat. No. 7,222,427.

BACKGROUND OF THE INVENTION

1. Field of the Invention

The present invention, in general, relates to personal grooming devices and, more particularly, to toe and finger nail clippers.

Nail clippers, the term herein including either toe or finger nail type of clippers, are generally well known.

Nail clippers have certain problems. For example, prior art designs tend to spray the clippings into a room. The clippings may be sharp and can even spread infection. Therefore, it is desirable to contain clippings.

However, prior art nail clippers include a center post that engages with a pivoting lever. The pivoting lever, pressing upon a ridge in the center post applies pressure to the clipper sufficient to urge a pair of opposite sides, and therefore also the blades, toward one-another during use.

The center post, though necessary, provides an obstruction that certain of the clippings inevitably must impact. The clippings bounce off of the center post and are scattered. Any prior art type of modification intended to retain the clippings has proven to be ineffective when they are bouncing off of the center post.

Other prior-art types of nail clippers do not fold sufficiently flat for storage. Others do not apply leverage that can create sufficient force to cut through difficult nails without requiring a great deal of force by the user.

Additionally, prior art nail clippers include considerable metal that has been machined. This is considerably more expensive than plastic, for example. However, all prior art designs have heretofore included a fully functional metallic nail clipper, with perhaps plastic surround components as well. This has been expensive.

There is a need to an inexpensive nail clipper. There is a need for a disposable nail clipper that is also inexpensive. Such a device could be given away at finer hotels or sold for minimum cost. It could also be a free item that included advertising, for example.

Nail clippers are expensive because of the machining that is required to manufacture the metal portions thereof. The top and bottom blades must not only be cut to a fine edge, but they must align precisely. It is relatively inexpensive to make a blade, but the manufacture of two blades that mesh precisely together, is what drives up the cost of manufacture.

Also, because nail clippers include so much metal, they are detected at airport security checks and often result in the searching of personal sundries that would not otherwise be so scrutinized. They may even be confiscated as a potentially dangerous weapon, which of course is a debatable assessment, but if confiscated it leaves the person without a nail clipper when they reach their destination. It is desirable to include so little metal with a nail clipper that it does not register as a potential threat during airport check-in procedures.

Accordingly, there exists today a need for a nail clipper with blade-insert that helps ameliorate the above-mentioned and other difficulties.

Clearly, such an apparatus would be a useful and desirable device.

2. Description of Prior Art

Nail clippers are, in general, known. While the structural arrangements of the above described known types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a nail clipper with blade-insert that is inexpensive to manufacture.

It is also an important object of the invention to provide a nail clipper with blade-insert that includes a replaceable cutting edge.

Another object of the invention is to provide a nail clipper with blade-insert that is primarily made of a plastic, nylon, or polymer.

Still another object of the invention is to provide a nail clipper with blade-insert that is aesthetically attractive.

Still yet another object of the invention is to provide a nail clipper with blade-insert that is sufficiently inexpensive to manufacture as to be disposable.

Yet another important object of the invention is to provide a nail clipper with blade-insert that includes a small cutting edge in a plastic frame.

Still yet another important object of the invention is to provide a nail clipper that includes a plastic frame that is attractive.

A first continuing object of the invention is to provide a nail clipper with blade-insert that is available in a desired color.

A second continuing object of the invention is to provide a nail clipper with blade-insert that is lightweight.

A third continuing object of the invention is to provide a nail clipper with blade-insert that includes a blade that is formed of a metallic or other suitable material and a second blade that is formed of a metallic or other suitable material and wherein the blade and the second blade are not formed of a continuous piece of the material.

Briefly, a nail clipper with blade-insert that is constructed in accordance with the principles of the present invention has a plastic frame with a pair of cutting blades that are attached to the plastic frame and face each other. According to a preferred embodiment the pair of cutting blades can be replaced with new blades. According to another preferred embodiment, the device is disposable. Various embodiments are shown which illustrate some of versatility and benefits that are possible.

Figure 2:
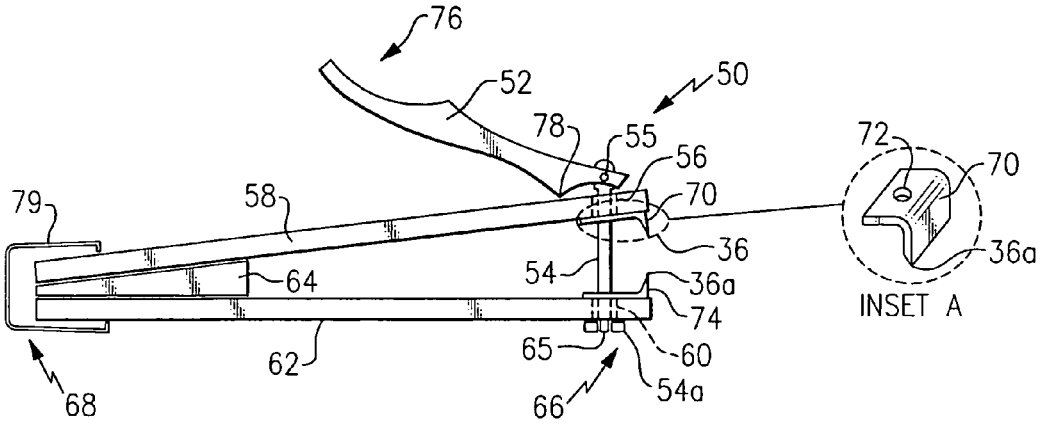
FIG. 2 is a side view of a second disposable type of a nail clipper with blade-insert.

INSET A is an enlarged view in perspective of a first modified blade of FIG. 2.

Figure 3:
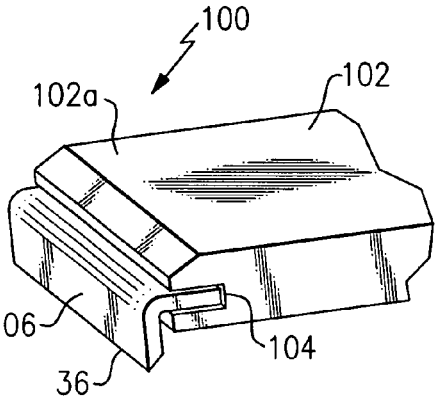

FIG. 3 is a view in perspective of a portion of a first half of a third disposable type of a nail clipper with blade-insert.

Figure 4:
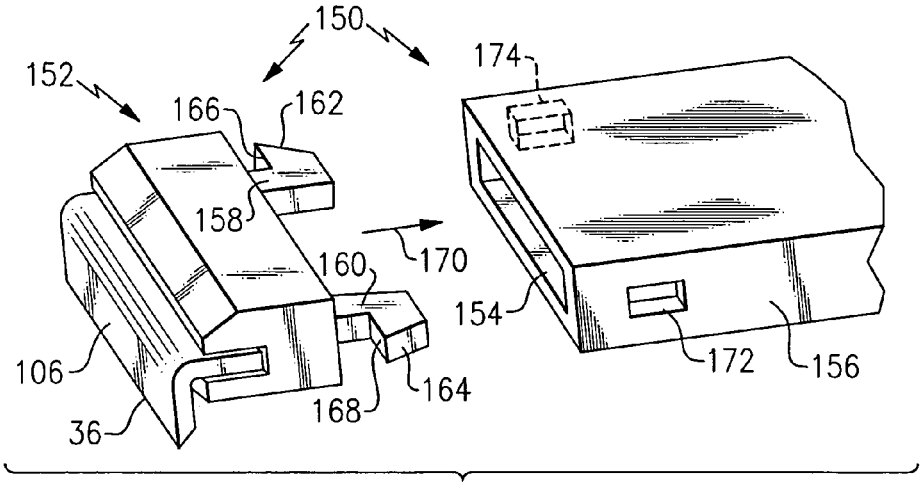

FIG. 4 is a view in perspective of a portion of a first half of a first replaceable blade type of a nail clipper with blade-insert with a replacement blade ready for insertion.

Figure 5:
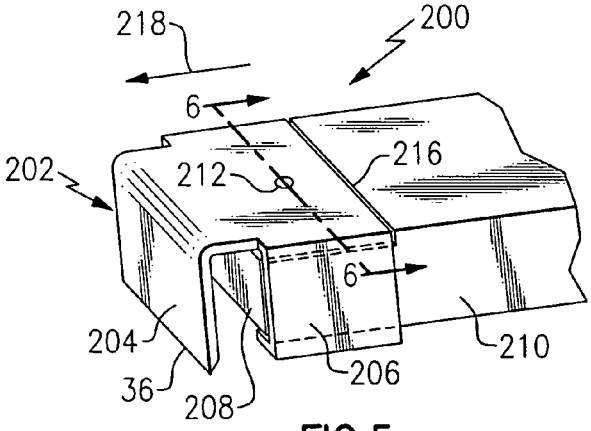

FIG. 5 is a view in perspective of a portion of a first half of a second replaceable blade type of a nail clipper with blade-insert with a replacement blade installed.

Figure 6:
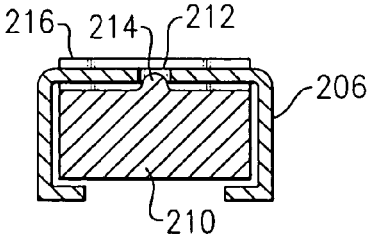

FIG. 6 is a cross-sectional view of the device of FIG. 5 taken along the line 6-6 in FIG. 5.

Figure 7:
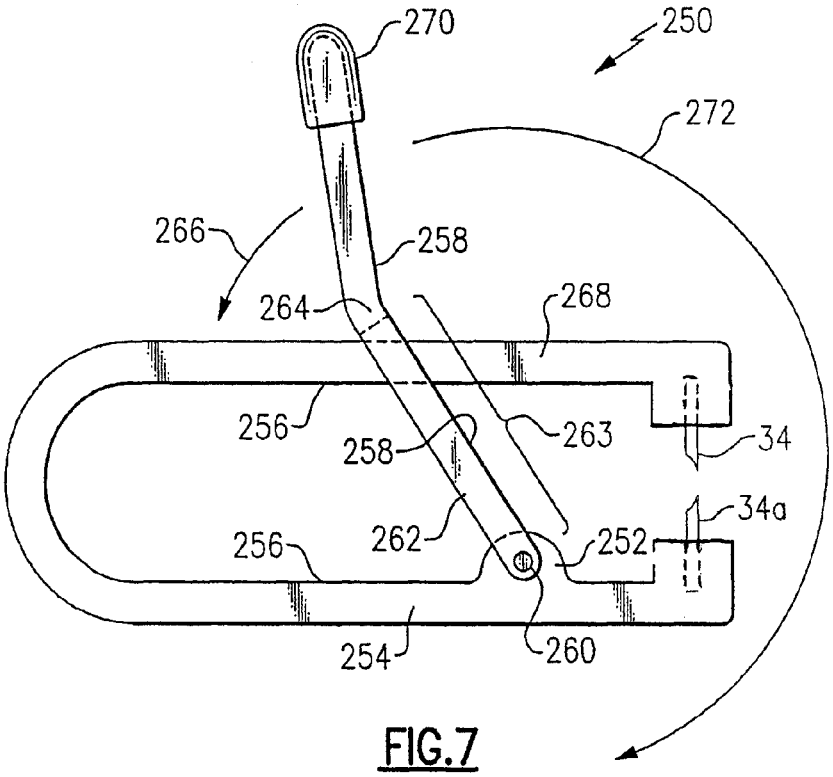

FIG. 7 is a side view of a fourth disposable type of a nail clipper with blade-insert.

Figure 8:
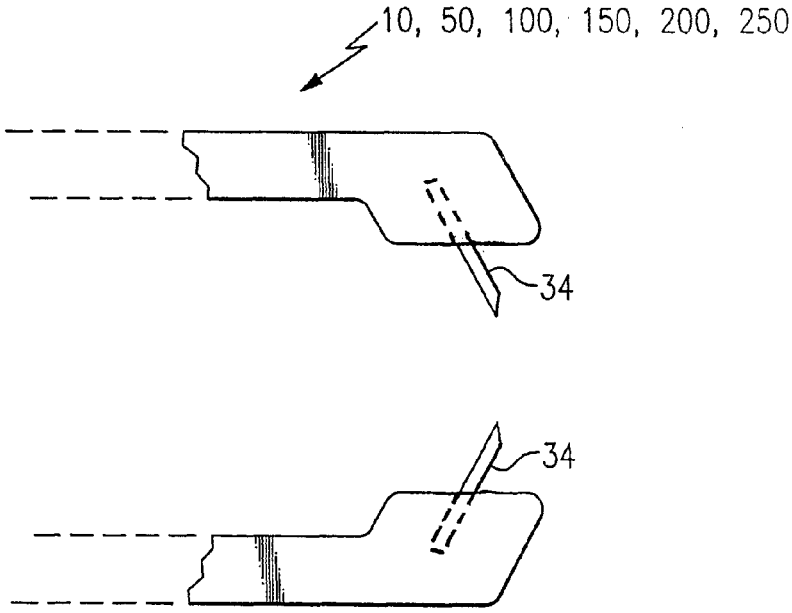

FIG. 8 is a side view of a modified way of mounting a cutting blade to a nail clipper with blade-insert.

DETAILED DESCRIPTION OF THE INVENTION

Figure 1:
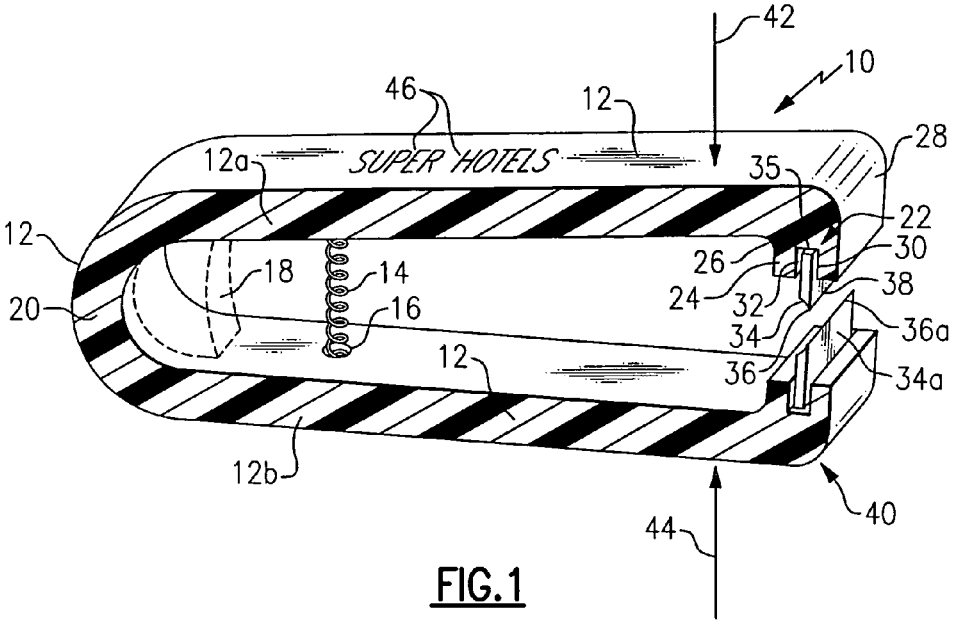
FIG. 1 is a view in perspective of a first disposable type of a nail clipper with blade-insert.

Referring to all of the drawing figures and now primarily to FIG. 1 is shown, a first disposable type of a nail clipper with blade-insert, identified in general by the reference numeral 10.

A one-piece plastic frame member 12 is molded out of a sufficient grade of plastic, nylon, or other material other than a metal.

A spring 14 is provided to push an upper half 12*a* of the frame member 12 away from a bottom half 12*b*. The spring 14 fits into a hole 16 provided in the bottom half 12*b* and a similar hole (not shown) that is provided in the top half 12*a*.

If desired, a greater amount of plastic material 18 (shown in dashed lines) is provided near a rear 20 of the frame member 12. The plastic material 18 is used instead of the spring 14 to urge the bottom half 12*b* away from the upper half 12*a* when no force is applied to any portion of the frame member 12.

If desired, other types of springs (not shown) can be used.

The upper half 12*a* of the frame member 12 of the first disposable type of a nail clipper with blade-insert 10 includes a first enlarged front portion, identified in general by the reference numeral 22.

The first enlarged front portion 22 includes a vertical section 24 that is generally perpendicular to a longitudinal axis of the upper half 12*a*. An inside radius 26 connects the vertical section 24 with the upper half 12*a* along an inside surface of the first disposable type of a nail clipper with blade-insert 10. An outside radius 28 similarly connects the vertical section 24 with the upper half 12*a* along an outside surface of the first disposable type of a nail clipper with blade-insert 10.

A first recess 30 is provided in a bottom surface 32 of the vertical section 24 that extends across the width thereof. The first recess 30 can be straight or it may include a curve, as desired.

A blade 34 is inserted into the first recess 30 and is held in place by friction or by any preferred method or combination of methods, as desired. For example, holes (not shown) can be provided through the blade 34. Plastic material from the vertical section 24 can extend through the holes sufficient to secure the blade 34 precisely in position. If desired, an adhesive 35 may be used.

The blade 34 includes a small piece of planar material with a cutting edge 36 that is disposed closest toward the bottom half 12*b*. The blade 34 is preferably formed of metal, although other materials, for example a ceramic material, can be used, if desired. The blade 34 preferably includes a curvature 38 along the cutting edge 36 as is common with prior art types of nail clippers (not shown).

The blade 34 small piece of planar material is sharpened and bent (if desired) prior to insertion into the first recess 30. As such, the cost of manufacture of the blade 34 is minimal.

The bottom half 12*b* includes a second enlarged front portion, identified in general by the reference numeral 40. The second enlarged front portion 40 is a mirror in construction and composition to the first enlarged front 22.

A second blade 34*a* of the second enlarged front 40 is identical to the blade 34, just oriented upside down with respect thereto.

A second cutting edge 36*a* of the second blade 34*a* aligns with the cutting edge 36 when the upper half 12*a* and the bottom half 12*b* of the frame member 12 are urged together.

The upper half 12*a* and the lower half 12*b* are urged toward each other when a force sufficient to overcome hysteresis and the force of the spring 14 is applied to the upper half 12*a* in the direction and location of arrow 42 and to the bottom half 12*b* in the direction and location of opposite arrow 44.

When urged together, the cutting edge 36 and the second cutting edge 36*a* align perfectly with respect to each other.

A finger nail (not shown) or a toe nail (not shown) is inserted between the blade 34 and the second blade 34*a* and is severed by the cutting edge 36 and by the second cutting edge 36*a* when sufficient force is applied to urge the upper half 12*a* and to the bottom half 12*b* toward each other.

Typically, a thumb and finger of a user can supply sufficient force to sever the nail. If desire, the first disposable type of a nail clipper with blade-insert 10 is modified to include a lever 52 (see FIG. 2) to apply greater force to urge the cutting edge 36 and the second cutting edge 36*a* together.

If desired, an advertisement 46 is provided wherever preferred on the frame member 12.

Because the cost of manufacture is so little for the first disposable type of a nail clipper with blade-insert 10, they can be sold at very low cost, used for a period of time until the cutting edge 36 and the second cutting edge 36*a* become dull, and then disposed of.

If the spring 14 is eliminated, other than the blade 34 and the second blade 34*a* there is no metal. Of course, the spring 14 could be changed from a coil-type of the spring 14 to include a leaf-type of the spring 14 that is disposed further toward the rear of the nail clipper with blade-insert 10 (not shown) than is the spring 14, as shown. This makes the first disposable type of a nail clipper with blade-insert 10 lightweight and very inexpensive to manufacture.

Unlike all known prior art types of nail clippers, the blade 34 and the second blade 34*a* are separate parts. They are not formed of a continuous piece of metal (as is the prior art). Because the blade 34 and the second blade 34*a* are not continuous, precision machining of the each prior art cutting edge with respect to the other is eliminated.

This greatly reduces the cost of manufacture because the blade 24 and the second blade 34*a*, being separate components, are easy to manufacture and to machine the cutting edge 36 and the second cutting edge 36*a*.

Luxury hotels can provide the first disposable type of a nail clipper with blade-insert 10 for free or at low cost. Manufacturers of any type of a product who wish to increase customer awareness of their products (or services) can include their name, telephone number, and website as part of the advertisement 46. The manufacturers may wish to give the first disposable type of a nail clipper with blade-insert 10 away for free.

Every time a person who has received one for free cuts his or her finger nails or toe nails, they are apt to be reminded of the manufacturer and to think favorably of the manufacturer. If repeated enough times, when a purchase decision is required by the person for a product offered by the manufacturer, it is likely that the name of the manufacturer will spring favorably to mind.

The frame member 12 can be any desired color of plastic. For example, a pink color of the frame member 12 may appeal to girls and women whereas another color may be more likely to appeal to boys and men.

Furthermore, because there is so little metal, airport security devices are not likely to detect the first disposable type of a nail clipper with blade-insert 10 during security screening. This prevents delays and possible confiscation of the first disposable type of a nail clipper with blade-insert 10 by overly zealous security personnel.

Referring now primarily to FIG. 2 is shown, a second disposable type of a nail clipper with blade-insert, identified in general by the reference numeral 50.

A plastic lever 52 is pivotally attached to a top of a vertical plastic pin 54 by a horizontal pin 55. The pin 54 passes through a pin hole 56 provided in a first modified frame member 58.

The pin 54 continues to pass through a second pin hole 60 provided in a second modified frame member 62. The first modified frame member 58 and the second modified frame member 62 are identical, just inverted with respect to each other. They are each formed of plastic or nylon preferably and include a center wedge 64 at an end opposite to where the pin 54 is disposed.

The pin 54 includes a split bottom 54*a*. The two opposite sides of the split bottom 54*a* are urged together sufficient to pass through second pin hole 60. A pin wedge 65 is urged into the split bottom 54*a* sufficient to spread the two opposite sides of the split bottom 54*a* apart an amount sufficient to prevent the split bottom 54*a* from passing back up and through the second pin hole 60.

The first modified frame member 58 and the second modified frame member 62 are preferably planar members that approximate the size of current prior art types of nail clippers. Prior art types of nail clippers come in a variety of sizes and it is to be understood that the instant invention can similarly be provided in a variety of sizes.

The wedge 64 is either welded (by ultrasound or other means) or adhered (by an adhesive) to the first modified frame member 58 and to the second modified frame member 62. Injection molding or other known or future manufacturing techniques can, of course, be used to form any version of the nail clipper with blade-insert 10, 50 (100, 150, 200, as described hereinafter).

The wedge 64 orients the first modified frame member 58 and the second modified frame member 62 in a spaced apart relationship where they are disposed further apart at a front, identified in general by the reference numeral 66 than at an opposite rear 68. If desired, the wedge 64 is molded as an integral part of the second disposable type of a nail clipper with blade-insert 50 so that the wedge 64, the first modified frame member 58, and the second modified frame member 62 are one continuous piece.

A first modified blade 70 includes a blade hole 72 through which the pin 54 passes. The first modified blade 70 includes the cutting edge 36 which is substantially identical to that of the first disposable type of a nail clipper with blade-insert 10. The first modified blade 70 is attached at the front 66 of the first modified frame member 58 by adhesive or any preferred means.

A second modified blade 74 is identical to the first modified blade 70 and is similarly attached in an inverted fashion to the second modified frame member 62 so that the cutting edge 36 and the second cutting edge 36*a* of the second modified blade 74 are aligned with respect to each other and face each other, as they did on the first disposable type of a nail clipper with blade-insert 10.

When the lever 52 is depressed in the direction of arrow 76, a fulcrum 78 of the lever 52 applies a mechanical advantage to the top of the first modified frame member 58 sufficient to urge it toward the second modified frame member 62.

The pin 54 prevents the second modified frame member 62 from moving away from first modified frame member 58 as the lever 52 is depressed. This causes the second modified blade 74 and the first modified blade 70 to move toward each other until the cutting edge 36 and the second cutting edge 36*a* align with each other and any finger nail or toe nail placed there-between has been severed.

The second disposable type of a nail clipper with blade-insert 50 shares the advantages of being lightweight, inexpensive to manufacture, low cost of purchase, space for the advertisement 46, and because of little metal, freedom from detection by airport security devices of the first disposable type of a nail clipper with blade-insert 10.

If desired, a retainer clip 79 can be inserted over the opposite rear 68 of the first modified frame member 58, the wedge 64, and the second modified frame member 62 to secure them together. The retainer clip 79 if formed of metal or any preferred material and can be crimped in place to provide a low-cost manufacturing method.

Referring now primarily to FIG. 3 is shown a portion of a first half of a third disposable type of a nail clipper with blade-insert, identified in general by the reference numeral 100.

A front portion 102*a* of a second modified frame member 102 is shown. The second modified frame member 102 and those portions of the third disposable type of a nail clipper with blade-insert 100 not shown or otherwise described as being different than the previously described embodiments, are substantially the same as with either the first disposable type of a nail clipper with blade-insert 10 or, alternately, the second disposable type of a nail clipper with blade-insert 50.

The front portion 102*a* includes a horizontal recess 104 into which a third modified blade 106 is disposed and attached in any preferred manner. For all embodiments described hereinafter, the cutting edge 36 is similarly included. Also, for all embodiments described hereinafter, a bottom half that is not shown includes a mirror image of the top portion which is shown and described. The cutting edge 36 will similarly align with the second cutting edge 36*a* (of the bottom half) when the bottom half is urged toward the top half (i.e., for example, toward the second modified frame member 102) that is shown.

The third disposable type of a nail clipper with blade-insert 100 provides the advantages of the previously described embodiments.

Referring now primarily to FIG. 4 is shown a portion of a first half of a first replaceable blade type of a nail clipper with blade-insert, identified in general by the reference numeral 150.

A replacement blade assembly, identified in general by the reference numeral 152 is shown in a spaced-apart orientation, ready for insertion into an open end 154 of a third modified frame member 156.

The replacement blade assembly 152 is similar to the front portion 102*a* of the third disposable type of a nail clipper with blade-insert 100. However, the replacement blade assembly 152 is detachably-attachable with respect to the third modified frame member 156.

A pair of tangs 158, 160 extend from the replacement blade assembly 152 and each include a respective beveled leading edge 162, 164. Each leading edge 162, 164 will extend progressively further away from a center of the replacement blade assembly as it passes toward the third modified blade 106 until it terminates at a retaining edge 166, 168 that are each perpendicular with respect to arrow 170.

The replacement blade assemblies 152 are expected to be sold in pairs for replacement of a prior set when the cutting edges 36, 36*a* of the first replaceable blade type of a nail clipper with blade-insert 152 become dull.

To remove a previously used and now dull replacement blade assembly 152 from the third modified frame member 156 (or bottom member; not shown), a force is simultaneously applied through a pair of side openings 172, 174 that are provided in the third modified frame member 156 to the two leading edges 162, 164.

The two leading edges are urged toward each other an amount sufficient to permit the retaining edges 166, 168 to clear the side openings 172, 174. The pair of tangs 158, 160 bend inward in response to the force that is applied.

A force in the opposite direction of arrow 170 is also simultaneously applied to the replacement blade assembly 152 while the leading edges 162, 164 are depressed. When the retaining edges 166, 168 clear the side openings 172, 174, the replacement blade assembly 152 is pulled out of the open end 154 of the third modified frame member 156.

This is repeated for both the first (top) half of the first replaceable blade type of a nail clipper with blade-insert 150 and also for the second (bottom) half (not shown).

To insert a new replacement blade assembly 152 after an older one has been removed, it is simply oriented as shown in the drawing and urged in the direction of arrow 170 until a click is heard as the retaining edges 166, 168 pass beyond the front edge of each of the side openings 172, 174. The replacement blade assembly 152 is accordingly held in position. Furthermore, the cutting edge 36 of the top replacement blade assembly 152 is aligned with the second cutting edge 36*a* (not shown) of the bottom replacement blade assembly 152.

An additional benefit is provided over the previous embodiments described herein. The additional benefit is that the first replaceable blade type of a nail clipper with blade-insert 150 can be restored to like-new cutting ability by periodically replacing the replacement blade assemblies 152. The replacement blade assemblies 152 are a consumable item, similar to razor blades, which can prove to be as profitable or potentially even more profitable than the sale of the first replaceable blade type of a nail clipper with blade-insert 150.

Referring now primarily to FIG. 5 and also to FIG. 6 is shown a portion of a first half of a second replaceable blade type of a nail clipper with blade-insert, identified in general by the reference numeral 200.

A second replacement blade assembly 202 includes a modified blade 204 that is attached to a channel member 206. The modified blade 204 and the channel member 206 are preferably formed of steel. The channel member 206 in cross-section (FIG. 6) includes a generally rectangular "C-shape" that is adapted to slide over an end 208 of a fourth modified frame member 210.

The second replacement blade assembly 202 includes an alignment hole 212. The fourth modified frame member 210 includes an alignment protrusion 214 that engages with the alignment hole 212 when the second replacement blade assembly 202 is fully inserted onto an end of the fourth modified frame member 210.

The alignment protrusion 214 disposed in the alignment hole 212 provides two benefits. Together, they ensure that the second replacement blade assembly 202 is fully and properly inserted on the fourth modified frame member 210 and they help retain the second replacement blade assembly 202 in position.

To ensure that the second replacement blade assembly 202 is not inserted too far onto the fourth modified frame member 210, an elevated ridge 216 is preferably included as part of the fourth modified frame member 210 that prevents over-insertion of the second replacement blade assembly 202.

To remove the second replacement blade assembly 202 from the fourth modified frame member 210 it is grasped and sufficient force is applied in the direction of arrow 218 while retaining the remainder of the second replaceable blade type of a nail clipper with blade-insert, identified in general by the reference numeral 200. The resistance provided by the alignment protrusion 214 in the alignment hole 212 is overcome and the second replacement blade assembly is separated apart from the fourth modified frame member 210.

To add a new second replacement blade assembly 202 it is urged in a direction opposite that of arrow 218 until the alignment protrusion 214 is in the alignment hole 212 and a rear edge of the second replacement blade assembly 202 is disposed against the elevated ridge 216.

Of course, when replacement is warranted, two of the second replacement blade assemblies 202 are used at both the top and bottom halves of the second replaceable blade type of a nail clipper with blade-insert 200.

If desired, the instant invention can, of course, be modified for use with the disclosure of the related patent application that was identified in the first sentence of the specification in such a way as to eliminate the prior art type of clipper that was used and to replace it with one of the embodiments, as described herein. Accordingly, patent application Ser. No. 11/226,811, entitled Nail Clipper, that was filed on Sep. 13, 2005, now U.S. Pat. No. 7,222,427 is incorporated herein by reference.

For example, referring now primarily to FIG. 7 is shown, a fourth disposable type of a nail clipper with blade-insert, identified in general by the reference numeral 250.

The fourth disposable type of a nail clipper with blade-insert 250 is similar to the first disposable type of a nail clipper with blade-insert 10. However, the fourth disposable type of a nail clipper with blade-insert 250 includes a raised pivot area 252 in a bottom half 254 of a further modified frame member 256. The further modified frame member 256 is preferably formed of plastic or nylon (not metal).

The raised pivot area 252 extends across the width of the bottom half 254. A modified lever 258 is preferably formed of a plastic or nylon and pivots about a bottom pivot pin 260. The bottom pivot pin 260 passes through the raised pivot area 252 and also through a bottom end of a pair of opposite lower sides 262 of the modified lever 258. The modified lever 258 is similar in design to that which was disclosed in the above-referenced pending patent application.

If desired, the bottom pivot pin 260 can be eliminated and a pair of modified bottom pivot pins (not shown) can instead be provided. The modified bottom pivot pins are each molded as a cylindrical extension to each of the pair of opposite lower sides 262 proximate the bottom thereof and extending inward a predetermined distance toward each other. A corresponding cylindrical opening is provided on each side of the raised pivot area 252 to receive one of the pair of modified bottom pivot pins.

This can help to lower manufacturing and assembly cost. To assemble the fourth disposable type of a nail clipper with blade-insert 250 when the pair of modified bottom pivot pins are used, the pair of opposite lower sides 262 are urged apart an amount sufficient to permit each of the modified bottom pivot pins to enter into the corresponding cylindrical openings in the raised pivot area 252, where they are urged inward by their own elastomeric properties. The modified bottom pivot pins then snap into the cylindrical openings where they are retained.

The pair of opposite lower sides 262 (the rear side is not visible) are disposed on opposite sides of the further modified frame member 256. The modified lever 258 includes an opening (as indicated by bracket 263) that extends from the bottom pivot pin 260 (i.e., the bottom of the modified lever 258) up to an upper cross member 264. The opening extends along the length of the opposite lower sides 262 as shown by bracket 263.

The upper cross member 264 extends across the width of the modified lever 258 and when the modified lever 258 is urged in the direction shown by arrow 266, the modified lever 258 bears against and urges an upper half 268 of the further modified frame member 256 toward the bottom half 254. The cutting blade 34 and the second cutting blade 34*a* are then drawn together sufficient to sever a toe nail or a finger nail.

The upper cross member 264 can extend up to and into a finger pad 270 or, if preferred, it can extend only partially along the remaining length of the modified lever 258. For storage, the modified lever 258 is pivoted about the bottom pivot pin 260 in the direction of arrow 272 until it is disposed under the bottom half 254 and is adjacent thereto.

The only metal used in the fourth disposable type of a nail clipper with blade-insert 250 are for the cutting blade 34 and the second cutting blade 34*a* and the bottom pivot pin 260. Of course, the bottom pivot pin 260 could be made of a material other than metal, if preferred. Also, if the modified bottom pivot pins are used instead of the bottom pivot pin 260, they would not be formed of metal.

Accordingly, the fourth disposable type of a nail clipper with blade-insert 250 includes all of the advantages of the first disposable type of a nail clipper with blade-insert 10 plus the added ease of use that is provided by the mechanical advantage created by the modified lever 258.

As disclosed, the fourth disposable type of a nail clipper with blade-insert 250 is expected to be used for a period of time and then disposed of. Depending on the quality of construction, the period of time can be less than, equal to, or even longer than that of the known prior-art types of nail clippers.

However, if preferred, it can be further modified so that it includes either the replacement blade assembly 152 or the second replacement blade assembly 202, or any other possible type of modified replacement blade assembly (not shown).

After having had benefit of the instant disclosure, it is anticipated that other and further modifications will be obvious to those possessing ordinary skill.

For example, the first enlarged front portion 22 of the first disposable type of a nail clipper with blade-insert 10, the second disposable type of a nail clipper with blade-insert 50, the third disposable type of a nail clipper with blade-insert 100, or the fourth disposable type of a nail clipper with blade-insert 250 could each be modified, as desired, so as not to be disposable but to include a preferred type of replacement blade assembly 152, 202 (or newly designed).

For example, any of the disposable types of a nail clipper with blade-insert 10, 50, 100, 250 can be modified to include the teachings of the first replaceable blade type of a nail clipper with blade-insert 150 (FIG. 4) including a modified replacement blade assembly (not shown).

The modified replacement blade assembly would be similar to the replacement blade assembly 152 except that the cutting blade 34 and the second cutting blade 34*a* of the modified replacement blade assembly would be attached vertically (as shown in FIG. 1 or FIG. 7) instead of horizontally, as shown in FIG. 4. This is to illustrate only a small sampling of the many modifications that are now possible regarding the replacement blade assemblies 152, 202.

Similarly, any disposable type of a nail clipper with blade-insert 10, 50, 100, 250 can be modified to include the second replaceable blade type of a nail clipper with blade-insert 200.

Also, any of the versions herein can include any type of an enclosure (not shown) to retain the nail clippings.

An additional modification could allow replacement of only the cutting blade 34 instead of the replacement blade assembly 152 (or the second replacement blade assembly 202) which include additional components other than the cutting blade 34.

For example, the first recess 30 could be modified to secure the cutting blade 34 in position, allow its withdrawal, and permit the insertion of a replacement cutting blade 34 therein.

As an example of a possible way to secure the cutting blade 34 in a modified type of a first recess (not shown), a modified type of a cutting blade (not shown) could include an opening into which a protrusion that is provided in the modified type of a first recess would engage, similar to way in which the alignment hole 212 and the alignment protrusion 214 cooperate.

The modified type of a cutting blade is grasped and pulled out and another is urged into the modified type of a first recess. This is generally not preferred over use of the replacement blade assemblies 152, 202 because of the possibility of injury occurring during removal or insertion of the modified type of a cutting blade into the modified type of a first recess.

Referring now to FIG. 8, for any version of the nail clipper with blade-insert 10, 50, 100, 150, 200, 250 the cutting blade 34 and the second cutting blade 34*a* require that the cutting edges 36, 36*a* contact each other when the device is urged into a closed position. The planar portion of each cutting blade 34, 34*a* does not have to be vertical or in parallel planar alignment with each other but could be disposed at an angle, if preferred.

If desired, the cutting blades 34, 34*a* could be formed of a material other than metal, for example, a ceramic material.

Other changes are also possible. As is well-known in the nail clipper arts, a radius is included in the cutting edges to provide a curvature to the nails (either toe or finger) when cut. Prior art designs machine the curvature into the cutting edges. However, with any version of the instant invention, the cutting blades 34, 34*a* can be formed of a flat material stock, if preferred, that is bent to provide the desired amount of curvature during assembly. This provides even lower cost for the manufacture of the cutting blades 34, 34*a*.

If preferred, any portion of any version of the instant invention as described herein that is formed of a plastic, nylon, or polymer, for example, can include either a solid core or a hollow core. Proper selection of materials and skilful design will, of course, allow minimal use of the plastic, nylon, or polymer. Not only does minimal use reduce manufacturing cost, it also reduces weight, which in turn, can substantially reduce shipping costs. This is especially true when compared with the known prior-art. Also, a lower weight makes portage of the instant invention easier to accomplish, whether it is placed in a pocket, purse, or added to a keychain, for example.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An improvement to a nail clipper, wherein the improvement comprises:

(a) a first cutting blade attached to an upper portion of said nail clipper, said first cutting blade including a metal;

(b) a second cutting blade attached to a lower portion of said nail clipper, said second cutting blade including a metal;

(c) wherein said upper portion always maintains a position of said first cutting blade with respect to said second cutting blade and wherein said lower portion always maintains a position of said second cutting blade with respect to said first cutting blade, and wherein said first cutting blade is disposed in a parallel and spaced-apart alignment with respect to said second cutting blade when said nail clipper is in a normal open state in which said first cutting blade and said second cutting blade are distally disposed with respect to each other, and wherein when a force is applied to said nail clipper sufficient to urge said first cutting blade and said second blade closer toward each other, said first cutting blade and said second cutting blade are progressively urged closer toward each other until contact occurs between said first cutting blade and said second cutting blade and wherein when said contact occurs said nail clipper is disposed in a closed state, and wherein said first cutting blade and said second cutting blade remain disposed in said parallel and spaced-apart alignment with respect to each other from said open state and also when said first cutting blade and said second cutting blade are progressively urged toward each other until said closed state occurs, and wherein when said closed state occurs said first cutting blade is disposed in said parallel alignment with respect to said second cutting blade, and wherein when said closed state occurs a first cutting edge of said first cutting blade and a second cutting edge of said second cutting blade are in contact with each other along an entire length of said first cutting edge and said second cutting edge, and wherein said first cutting edge is parallel with respect to said second cutting edge when said first cutting edge is in contact with said second cutting edge and also whenever said first cutting edge is disposed away from said second cutting edge;

(d) wherein said upper portion includes a member and wherein said first cutting blade is attached to said member and wherein said lower portion includes said member and wherein said second cutting blade is attached to said member and wherein said member is not formed of a metal and wherein said member is contiguous and extends from said first cutting blade to said second cutting blade; and (e) wherein said member includes a longitudinal axis that extends along a longitudinal length of said member, and wherein said first cutting edge of said first cutting blade and said second cutting edge of said second cutting blade are generally perpendicular with respect to said longitudinal axis, and wherein during use said first cutting edge and said second cutting edge are disposed in parallel alignment with respect to each other sufficient to cause said first cutting edge and said second cutting edge to abut each other when urged together without overlap when said nail clipper is disposed in said closed state;

and wherein during use said nail clipper severs a portion of a nail simultaneously across a width of said nail that is disposed between said first cutting edge and said second cutting edge by a deepening of a first cut that is progressively occurring along an upper surface of said nail and by a simultaneous deepening of a second cut that is progressively occurring along a bottom surface of said nail until said first cut and said second cut intersect, and wherein said first cut and said second cut intersect at the moment when said contact occurs between said first cutting blade and said second cutting blade, and wherein when said contact occurs, said first cutting edge and said second cutting edge abut each other and wherein when said first cutting edge and said second cutting edge abut each other, said nail clipper is disposed in said closed state and said portion of said nail is severed from a remaining portion of said nail, and wherein said nail clipper does not sever any of said portion of said nail by a type of a cut that includes an overlap of said first cutting edge with respect to said second cutting edge that initially begins to sever said nail at a first side of said nail when said first cutting edge overlaps said second cutting edge at said first side of said nail, and wherein said type of a cut that includes said overlap progressively continues to sever said portion of said nail from said first side of said nail toward an opposite second side of said nail as said overlap progressively extends from said first side of said nail toward said second side until said portion of said nail is severed, and wherein said nail clipper does not include any additional cutting blades attached thereto other than said first cutting blade and said second cutting blade.

2. An improvement to a nail clipper, wherein the improvement comprises:

(a) including a body of said nail clipper that is not made of a metal; and (b) including means for attaching a pair of cutting blades to said body, and wherein a first of said cutting blades is formed of a first material and wherein a second of said cutting blades is formed of said first material, and wherein a second material that is different than said first material is included in said body and wherein said second material is disposed between said first of said cutting blades and said second of said cutting blades; and (c) wherein said body includes a longitudinal axis that extends along a longitudinal length of said body, and wherein a first cutting edge of said first of said cutting blades and a second cutting edge of said second of said cutting blades are generally perpendicular with respect to said longitudinal axis, and wherein during use said first cutting edge and said second cutting edge are disposed in parallel alignment with respect to each other sufficient to cause said first cutting edge and said second cutting edge to abut each other when urged together without overlap when said nail clipper is disposed in a closed state, and wherein said first cutting edge is parallel with respect to said second cutting edge when said first cutting edge is in contact with said second cutting edge in said closed state and when said first cutting edge is disposed maximally away from said second cutting edge and said nail clipper is disposed in an open state, and wherein said first cutting edge is disposed in a parallel and spaced-apart orientation with respect to said second cutting edge when said nail clipper is disposed in any position other than in said closed state;

and wherein during use said nail clipper severs a nail simultaneously across a width of said nail by a deepening of a first cut that is progressively occurring along an upper surface of said nail and by a simultaneous deepening of a second cut that is progressively occurring along a bottom surface of said nail until said first cut and said second cut intersect and said nail is severed when said first and second cutting blades are urged toward each other, and wherein said body includes opposite ends and wherein said first cutting blade is attached to a first end of said body and wherein said second cutting blade is attached to an opposite second end of said body, and wherein a force is applied to urge said first end of said body toward said second end of said body sufficient to urge said first cutting blade and said second cutting blade toward each other and said nail clipper from said open state into said closed state.

3. A nail clipper with blade-insert, comprising:

(a) an upper frame member that is not made of a metal;

(b) a lower frame member that is not made of a metal;

(c) means for attaching a rear of said upper frame member and a rear of said lower frame member together;

(d) means for supplying a force sufficient to urge a front of said upper frame member apart from a front of said lower frame member when said nail clipper is in a quiescent state;

(e) means for attaching a first cutting blade to said front of said upper frame member, said first cutting blade including a first cutting edge, said first cutting edge disposed toward said lower frame member, and means for attaching a second cutting blade to said front of said lower frame member, said second cutting blade including a second cutting edge, said second cutting edge facing toward said first cutting edge and said second cutting edge disposed in a parallel alignment with respect to said first cutting edge; and (f) wherein said first cutting blade and said second cutting blade are each formed of a first material, and wherein said upper frame member or said lower frame member include a second material, and wherein said second material is different than said first material, and wherein said second material is disposed between said first cutting blade and said second cutting blade; and (g) wherein said upper frame member includes a first longitudinal axis that extends along a longitudinal length of said upper frame member and wherein said lower frame member includes a second longitudinal axis that extends along a longitudinal length of said lower frame member, and wherein said first cutting edge and said second cutting edge are generally perpendicular with respect to said first longitudinal axis and said second longitudinal axis, and wherein during use said first cutting edge and said second cutting edge are disposed in parallel alignment with respect to each other sufficient to cause said first cutting edge and said second cutting edge to abut each other when urged together without overlap when said nail clipper is disposed in a closed state, and wherein said first cutting edge is parallel with respect to said second cutting edge when said first cutting edge is in contact with said second cutting edge and wherein when said first cutting edge is disposed maximally away from said second cutting edge said nail clipper is disposed in an open state, and wherein said first cutting edge is disposed in a parallel and spaced-apart orientation with respect to said second cutting edge when said nail clipper is disposed in any position other than in said closed state;

and wherein during use said nail clipper severs a nail simultaneously across a width of said nail by a deepening of a first cut that is progressively occurring along an upper surface of said nail and by a simultaneous deepening of a second cut that is progressively occurring along a bottom surface of said nail until said first cut and said second cut intersect and said nail is severed when said front of said upper frame member is urged toward said front of said lower frame member, and wherein when said front of said upper frame member is urged toward said front of said lower frame member, said first and second cutting blades are urged toward each from said open state to said closed state, and wherein a force is applied to urge said front of said upper frame member toward said front of said lower frame member sufficient to urge said first cutting blade and said second cutting blade toward each other and said nail clipper from said open state into said closed state.

4. The nail clipper with blade-insert of claim 3 wherein said upper frame member and said lower frame member are formed of plastic.

5. The nail clipper with blade-insert of claim 3 wherein said upper frame member and said lower frame member are formed of a contiguous piece of material.

6. The nail clipper with blade-insert of claim 3 wherein said means for attaching said rear of said upper frame member and said rear of said lower frame member together includes a retaining clip.

7. The nail clipper with blade-insert of claim 3 wherein said means for supplying a force sufficient to urge said front of said upper frame member apart from said front of said lower frame member includes a wedge disposed between said rear of said upper frame member and said rear of said lower frame member, and wherein a thinner end of said wedge is disposed maximally away from said front of said upper frame member and from said front of said lower frame member and wherein a resiliency provided by said wedge is sufficient to urge said upper frame member away from said lower frame member and wherein said front of said upper frame member is subsequently urged away from said front of said lower frame member.

8. The nail clipper with blade-insert of claim 3 wherein said means for attaching said first cutting blade to said front of said upper frame member includes means for adhering said first cutting blade to said front of said upper frame member.

9. The nail clipper with blade-insert of claim 3 wherein said means for attaching said second cutting blade to said front of said lower frame member includes means for adhering said second cutting blade to said front of said lower frame member.

10. The nail clipper with blade-insert of claim 3 wherein said means for attaching said first cutting blade to said front of said upper frame member includes means for molding said first cutting blade to said front of said upper frame member.

11. The nail clipper with blade-insert of claim 3 wherein said means for attaching said second cutting blade to said front of said lower frame member includes means for molding said second cutting blade to said front of said lower frame member.

12. An improvement to a nail clipper, wherein the improvement comprises:

(a) a first cutting blade attached to an upper portion of said nail clipper, said first cutting blade including a material other than a metal;

(b) a second cutting blade attached to a lower portion of said nail clipper, said second cutting blade including a material other than a metal;

(c) wherein at least a portion of said first cutting blade is disposed in parallel alignment with respect to at least a portion of said second cutting blade sufficient to permit a first cutting edge of said first cutting blade and a second cutting edge of said second cutting blade to contact each other when said upper portion and said lower portion are urged toward each other and said nail clipper is disposed in a closed state; and (d) wherein said first cutting blade does not include a member that is formed of a metal that is attached thereto and which extends from said first cutting blade to said second cutting blade; and (e) wherein said upper portion includes a first longitudinal axis that extends along a longitudinal length of said upper portion and wherein said lower portion includes a second longitudinal axis that extends along a longitudinal length of said lower portion, and wherein said first cutting edge and said second cutting edge are generally perpendicular with respect to said first longitudinal axis and said second longitudinal axis, and wherein during use when said first cutting edge and said second cutting edge are in contact with each other, they abut each other and do not overlap, and wherein said first cutting edge is parallel with respect to said second cutting edge when said first cutting edge is in contact with said second cutting edge and said nail clipper is disposed in said closed state and wherein when said first cutting edge is disposed maximally away from said second cutting edge said nail clipper is disposed in an open state, and wherein said first cutting edge is disposed in a parallel and spaced-apart orientation with respect to said second cutting edge when said nail clipper is disposed in any position other than in said closed state;

and wherein during use said nail clipper severs a nail simultaneously across a width of said nail by a deepening of a first cut that is progressively occurring along an upper surface of said nail and by a simultaneous deepening of a second cut that is progressively occurring along a bottom surface of said nail until said first cut and said second cut intersect and said nail is severed when said upper portion is urged toward said lower portion, and wherein when said upper portion is urged toward said lower portion, said first and second cutting blades are urged toward each other from said open state to said closed state, and wherein a force is applied to urge said upper portion toward said lower portion sufficient to urge said first cutting blade and said second cutting blade toward each other and said nail clipper from said open state into said closed state.

13. A nail clipper with blade-insert, comprising:

(a) an upper frame member that is not made of a metal;

(b) a lower frame member that is not made of a metal;

(c) means for attaching a rear of said upper frame member and a rear of said lower frame member together;

(d) means for supplying a force sufficient to urge a front of said upper frame member apart from a front of said lower frame member when said nail clipper is in a quiescent state;

(e) means for attaching a first cutting blade to said front of said upper frame member, said first cutting blade including a first cutting edge, said first cutting edge disposed toward said lower frame member, and means for attaching a second cutting blade to said front of said lower frame member, said second cutting blade including a second cutting edge, said second cutting edge facing toward said first cutting edge and said second cutting edge disposed in a parallel alignment with respect to said first cutting edge; and (f) wherein said first cutting blade and said second cutting blade are each formed of a first material, and wherein said upper frame member or said lower frame member include a second material, and wherein said second material is different than said first material, and wherein said second material is disposed between said first cutting blade and said second cutting blade;

(g) wherein said upper frame member includes a first longitudinal axis that extends along a longitudinal length of said upper frame member and wherein said lower frame member includes a second longitudinal axis that extends along a longitudinal length of said lower frame member, and wherein said first cutting edge and said second cutting edge are generally perpendicular with respect to said first longitudinal axis and said second longitudinal axis, and wherein during use said first cutting edge and said second cutting edge are disposed in parallel alignment with respect to each other sufficient to cause said first cutting edge and said second cutting edge to abut each other when urged together without overlap and wherein said nail clipper is disposed in a closed state when said first cutting edge and said second cutting edge abut each other, and wherein said first cutting edge is parallel with respect to said second cutting edge when said nail clipper is disposed in said closed state and wherein when said first cutting edge is disposed maximally away from said second cutting edge said nail clipper is disposed in an open state and wherein said first cutting edge is disposed in a parallel and spaced-apart orientation with respect to said second cutting edge when said nail clipper is disposed in any position other than in said closed state; and (h) wherein said means for supplying a force sufficient to urge said front of said upper frame member apart from said front of said lower frame member includes a wedge disposed between said rear of said upper frame member and said rear of said lower frame member, and wherein a thinner end of said wedge is disposed maximally away from said front of said upper frame member and from said front of said lower frame member, and wherein a resiliency provided by said wedge is sufficient to urge said upper frame member away from said lower frame member and wherein said front of said upper frame member is subsequently urged away from said front of said lower frame member;

and wherein during use said nail clipper severs a nail simultaneously across a width of said nail by a deepening of a first cut that is progressively occurring along an upper surface of said nail and by a simultaneous deepening of a second cut that is progressively occurring along a bottom surface of said nail until said first cut and said second cut intersect and said nail is severed when said nail clipper is urged from said open state to said closed state, and wherein a force is applied to urge said upper frame member toward said lower frame member sufficient to urge said first cutting blade and said second cutting blade toward each other and said nail clipper from said open state into said closed state.

* * * * *